US006227663B1

(12) United States Patent
Santhanam et al.

(10) Patent No.: US 6,227,663 B1
(45) Date of Patent: May 8, 2001

(54) INK-JET PRINT CARTRIDGE HAVING A LOW PROFILE

(75) Inventors: Ram Santhanam; Junji Yamamoto; Marcus Scholz, all of San Diego; Daniel S Kline, Encinitas, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/477,646

(22) Filed: Jan. 5, 2000

(51) Int. Cl.[7] ..... B41J 2/175
(52) U.S. Cl. ..... 347/87; 347/86
(58) Field of Search ..... 347/85, 86, 87

(56) References Cited

U.S. PATENT DOCUMENTS 5,595,223 * 1/1997 Hayao ..... 347/87
5,984,465 * 11/1999 Yun ..... 347/87
6,070,974 * 6/2000 Kotaki et al. ..... 347/86

* cited by examiner

*Primary Examiner*—N. Le
*Assistant Examiner*—Anh T. N. Vo

(57) ABSTRACT

An ink-jet print cartridge having a low profile. The print cartridge includes a print cartridge body, a lid securely affixed to the body, and a latch located on the lid. The print cartridge further includes two elongate supporting lips located along the side walls of the body for supporting the print cartridge during loading. Loading is effected with a plurality of gripping surfaces remotely located from the latch.

9 Claims, 5 Drawing Sheets

INK-JET PRINT CARTRIDGE HAVING A LOW PROFILE

RELATED APPLICATIONS

This application is related to the following copending utility patent applications, each filed concurrently on Jan. 5, 2000:

Ser. No. 09/477,644, by Junji Yamamoto et al., entitled "Horizontally Loadable Carriage For An Ink-Jet Printer";

Ser. No. 09/477,645, by Ram Santhanam et al., entitled "Vent For An Ink-Jet Print Cartridge";

Ser. No. 09/477,648 by Matt Shepherd et al., entitled "New Method of Propelling An Inkjet Printer Carriage";

Ser. No. 09/477,649, by Junji Yamamoto et al., entitled "Method And Apparatus For Horizontally Loading And Unloading An Ink-Jet Print Cartridge From A Carriage";

Ser. No. 09/477,843, by Ram Santhanam et al., entitled "Techniques For Adapting A Small Form Factor Ink-Jet Cartridge For Use In A Carriage Sized For A Large Form Factor Cartridge";

Ser. No. 09/477,860, by Keng Leong Ng, entitled "Low Height Inkjet Service Station";

Ser. No. 09/477,940, by Ram Santhanam et al., entitled "Multiple Bit Matrix Configuration For Key-Latched Printheads";

Ser. No. 09/478,148, by Richard A. Becker et al., entitled "Techniques For Providing Ink-Jet Cartridges With A Universal Body Structure";

Ser. No. 09/478,190, by James M. Osmus, entitled "Printer With A Two Roller, Two Motor Paper Delivery System"; and Ser. No. 29/116,564, by Ram Santhanam et al., entitled "Ink Jet Print Cartridge", all of which are incorporated by reference.

FIELD OF INVENTION

The present invention generally relates to ink-jet print cartridges and, more particularly, to their construction.

BACKGROUND OF THE INVENTION

The general construction and operation of an ink-jet print cartridge using reticulated polyurethane foam is disclosed in U.S. Pat. No. 4,771,295 entitled "Thermal Ink Jet Pen Body Construction Having Improved Ink Storage and Feed Capacity" by Baker et al. issued Sep. 13, 1988.

Prior print cartridges have been designed to be loaded into and removed from ink-jet printers either vertically or with an inclined arcuate motion. Such a procedure has proven to be satisfactory as long as vertical access to the printer is provided. This has meant, however, that nothing could be permanently stacked on top of the printer.

Further, previous top loading ink-jet printer designs have fostered an increasing growth in printer height so that with each new printer design the profile of the product grew and grew.

Finally, there is a constant need to reduce the cost and the development time for new printer products. This has caused product designers to leverage existing designs and use parts from current products when developing new products for the market place. This desire to reduce start-up costs also has lead product designers to utilize existing tooling and manufacturing lines as well.

Thus, it is apparent from the foregoing that although there are many satisfactory ink-jet print cartridge designs, there is a need for an approach that permits the front loading of print cartridges into printers, reduces the profile of the cartridge itself, uses parts from products currently in production, and utilizes existing manufacturing lines.

SUMMARY OF THE INVENTION

Briefly and in general terms, an ink-jet print cartridge according to the invention includes a print cartridge body, a lid securely affixed to the body, and a latch located on the lid and displaced away from the margin of the lid and the body.

An other aspect of the invention includes an ink-jet print cartridge having an elongate lip located on a side wall of the cartridge for supporting the cartridge during loading.

Still a further aspect of the invention includes a gripping surface remotely located from the latch for aiding the user when loading and unloading the print cartridge from the printer.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
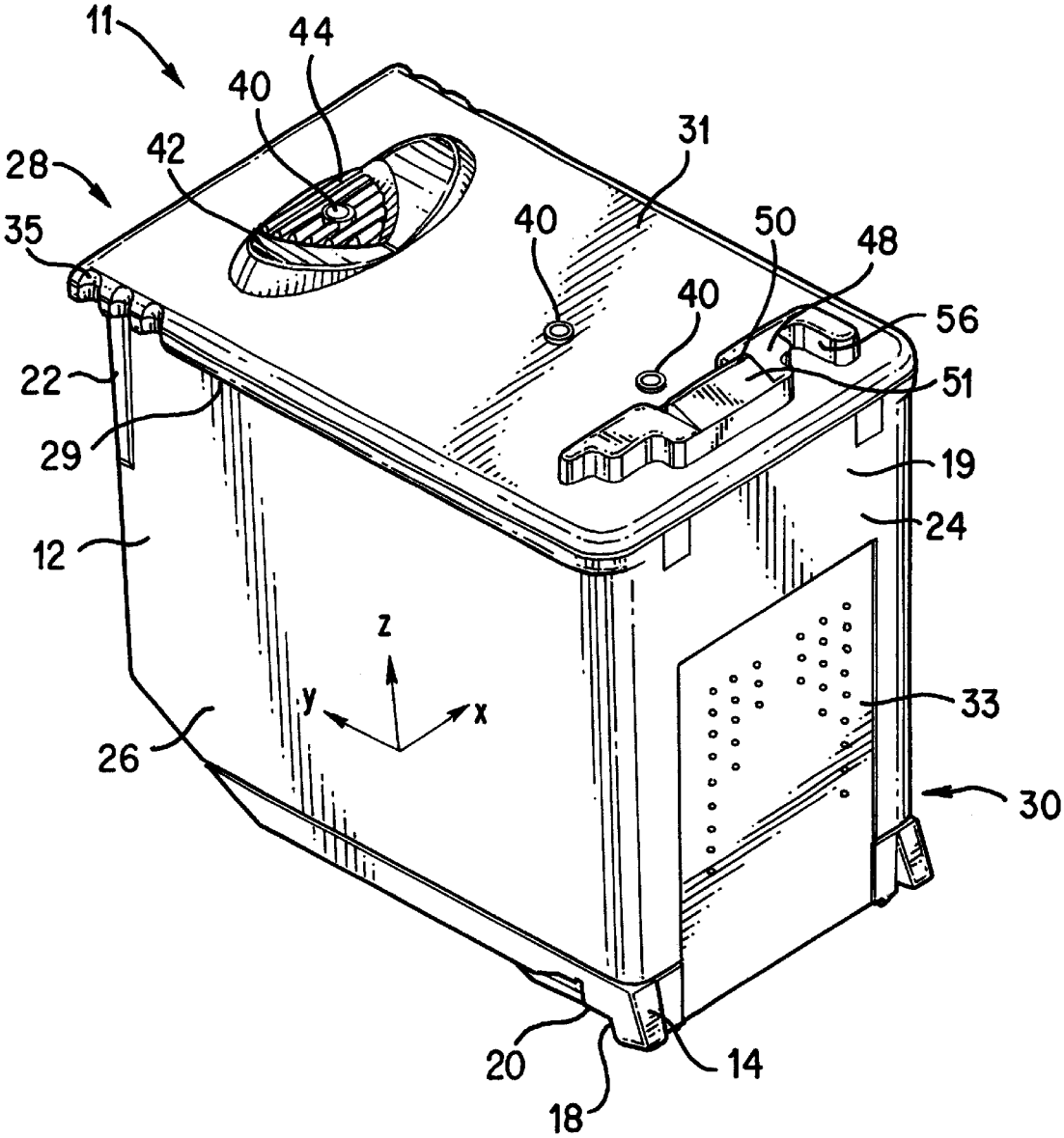
FIG. 1 is a perspective view, of an ink-jet print cartridge embodying the principles of the invention.

As shown in the drawings for the purposes of illustration, the invention is embodied in an ink-jet print cartridge having a low profile for front loading into a printer. The print cartridge also includes gripping surfaces and physical features that suggest to the user how to insert and remove the cartridge from a printer.

The print cartridge offers a simple solution and easy operation, incorporates many currently manufactured components, and is produced on existing manufacturing lines with minimal start-up tooling costs.

Referring to FIGS. 1–7, reference numeral 11 generally indicates an ink-jet print cartridge for a printer. The print cartridge includes a print cartridge body 12 that is generally rectangular in shape with a front wall 24, a left side wall 25, a right side wall 26, and a back wall 27. The print cartridge body houses three ink chambers for holding inks of the various hues, cyan, magenta, and yellow. The ink chambers are filled with reticulated polyurethane foam. The foam is compressed to maintain the back pressure of the ink at the print head 15, FIG. 6. In the bottom of each chamber is a stand pipe and filter of conventional construction to insure that particles do not clog the nozzles.

Figure 2:
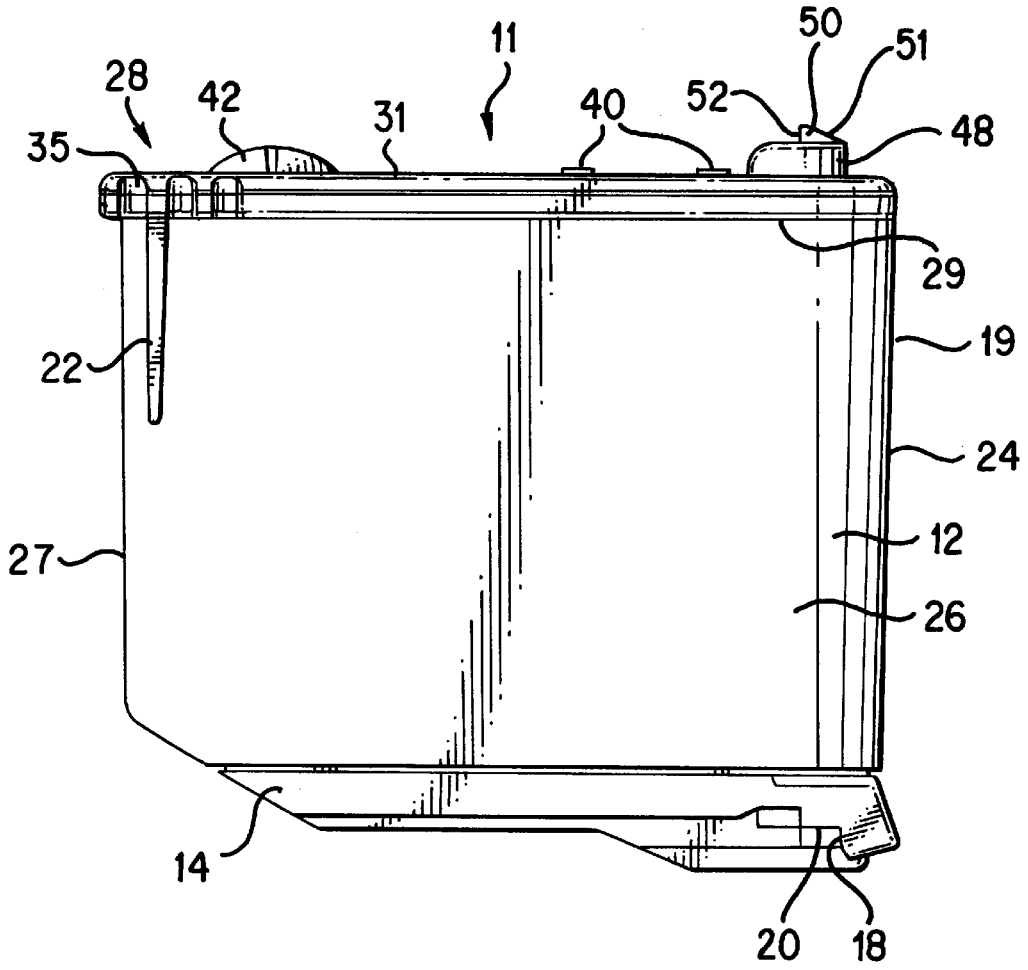
FIG. 2 is a right side elevational view of the print cartridge of FIG. 1.
Figure 3:
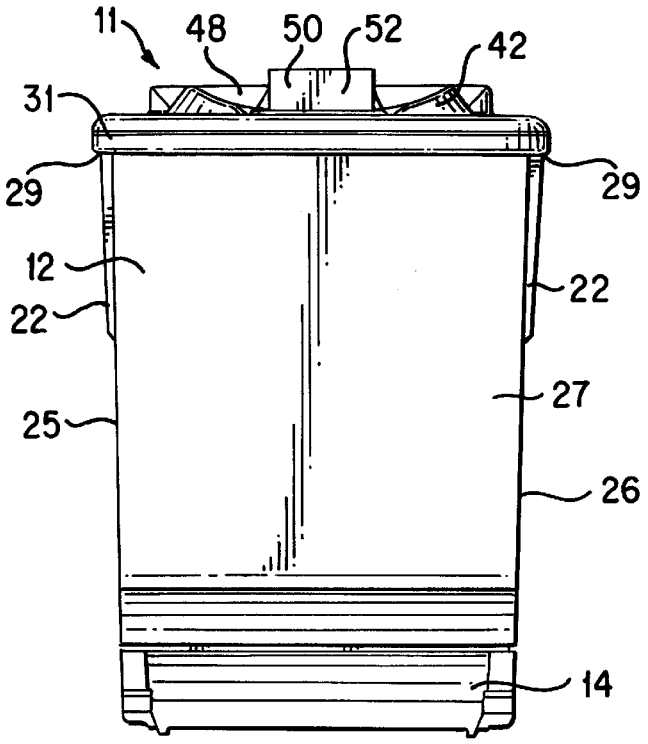
FIG. 3 is a back side elevational view of the print cartridge of FIG. 1.
Figure 5:
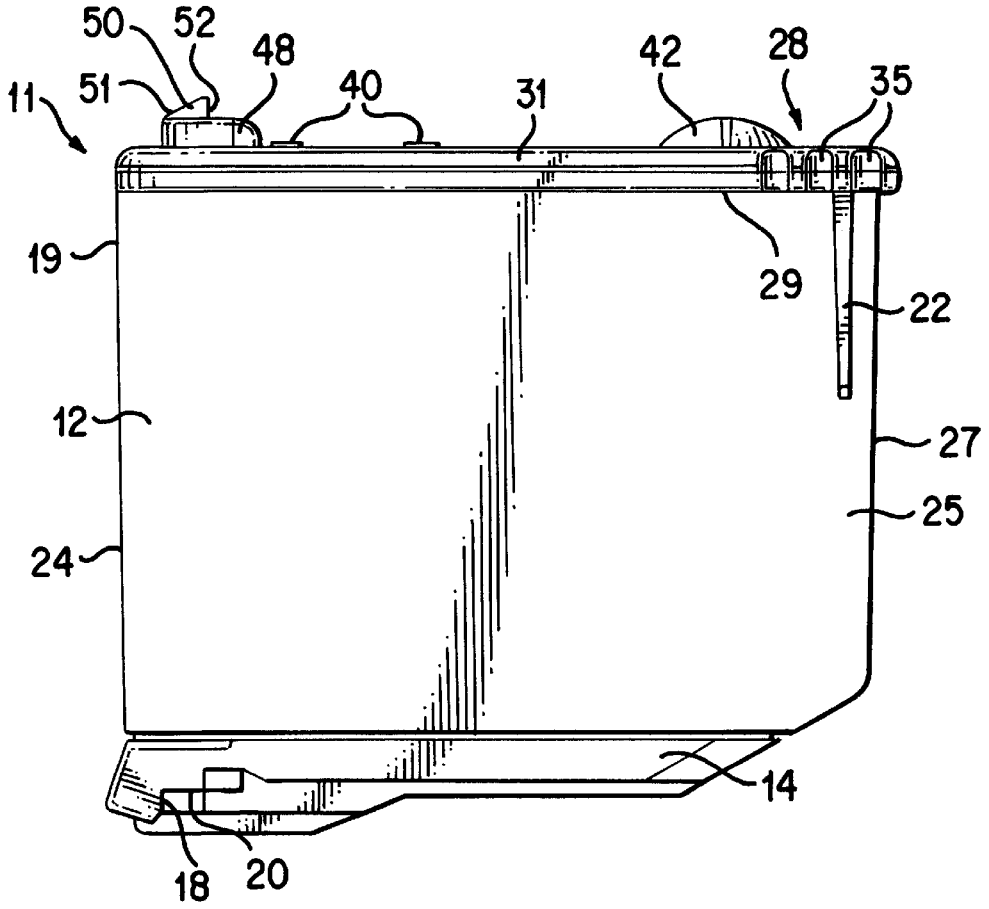
FIG. 5 is a left side elevational view of the print cartridge of FIG. 1.
Figure 6:
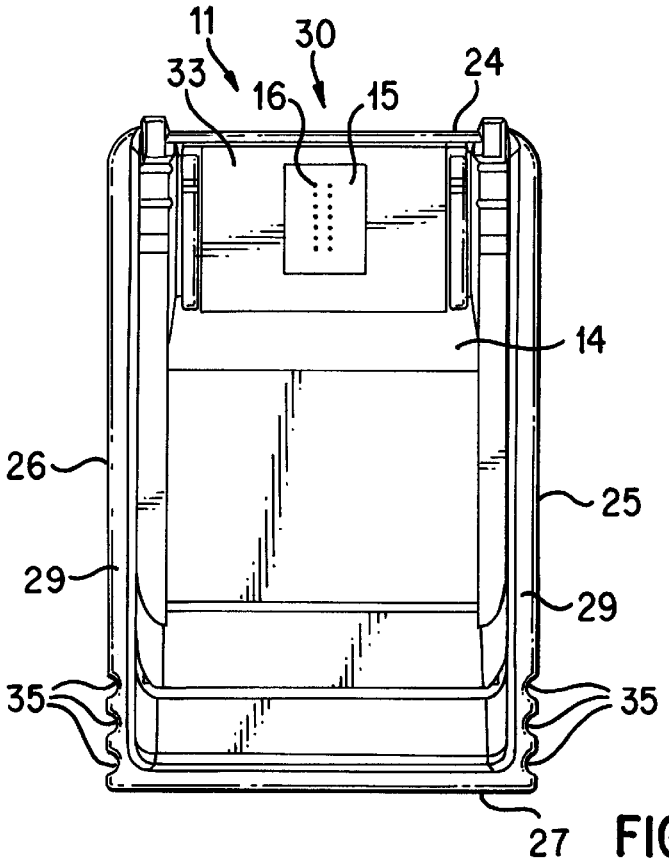
FIG. 6 is a bottom plan view of the print cartridge of FIG. 1.

The print cartridge body 12 also includes a nose piece 14 that is ultrasonically welded to the body. The nose piece contains three channels that each connect to a stand pipe in one of the ink chambers. The channels direct the ink from the chambers to one of three series of nozzles 16, FIG. 6, on the print head 15. Located on the nose piece 14, FIGS. 2 and 5, are an X axis datum 18 and an Z axis datum 20. These datums are holding points. The Y axis datum 19, FIG. 1, is the front wall 24 of the print cartridge and is a stop point. These datums mate with corresponding features on the carriage of the printer and locate the print cartridge in the printer during operation.

Referring to FIGS. 1, 2, and 5, reference numeral 22 generally indicates two ribs that serve as gripping surfaces when the print cartridge 11 is removed from the printer. Each rib is located vertically on one of the side walls 25, 26, along the common margins between the side walls 25 and 26 and the back wall 27 of the print cartridge body 12.

Referring to FIGS. 1, 2, 3, 4, and 5, reference numeral 29 generally indicates an elongate supporting lip located on the two side walls 25, 26 and the back wall 27 of the print cartridge body 12. The lip is located along the margin between the print cartridge body 12 and the lid 31, described in detail below. The portions of the lip 29 located on the side walls 25, 26, FIGS. 3 and 4, support and guide the print cartridge during loading and unloading from a printer. These portions of the lip engage a pair of corresponding guide rails or loading ramps on the carriage of the printer.

Figure 4:
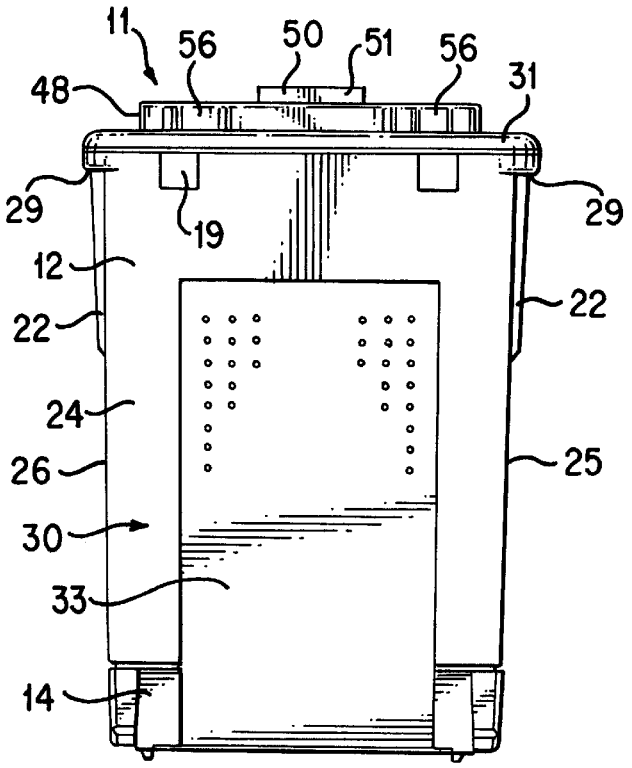
FIG. 4 is a front side elevational view of the print cartridge of FIG. 1.

Also located on the print cartridge body 12, FIGS. 1 and 4, is a flex circuit 33 of conventional construction. The flex circuit provides the electrical inter-connection between the printer and the print head 15, FIG. 6, and routes electrical energy to the appropriate firing resistors during printing.

Figure 7:
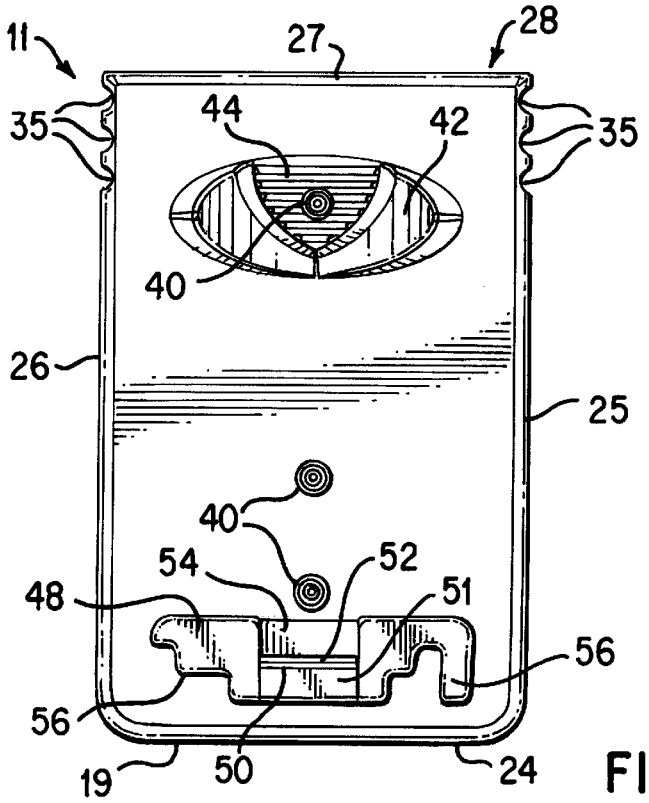
FIG. 7 is a top plan view of the print cartridge of FIG. 1.

Referring to FIGS. 1 and 7, reference numeral 35 indicates a plurality of gripping groves located along the margin between the lid 31, described in detail below, and the side walls 25, 26 of the print cartridge body 12. The gripping groves serve as a gripping surface on the print cartridge 11 from removing the print cartridge from a printer once the print cartridge has been released from the carriage. The gripping groves also serve as a visual indication with respect to any adjacent print cartridges that the associated print cartridge has been released from the carriage.

Referring to FIGS. 1, 2, 3, 4, and 5, reference numeral 31 generally indicates a lid having a planer outside surface. The plane of the outside surface of the lid is also parallel to the supporting lip 29. The lid 31 is ultrasonically welded to the print cartridge body 12 along the margin of the side walls 25 and 26, the front wall 24, and the back wall 27. The lid seals the ink in the ink reservoir chambers within the print cartridge body 12. The lid also contains three vents 40, FIGS. 1 and 7 that allow air at atmospheric pressure to enter each of the reservoir chambers.

Located on the lid 31, FIGS. 1 and 7, proximate to the margin between the back wall 27 and the lid is a button-like structure 42. In the top plan view of the print cartridge 11, FIG. 7, this structure has an elliptical shape. In the back side elevational view, FIG. 3, this structure has an outward opening, circular shape. In the side elevational views, FIGS. 2 and 5, this structure has the shape of a chord of a circle. The middle of this structure is flush with the outside surface of the lid 31 and contains a plurality of groves 44. The groves act as a gripping surface for the user. This structure has this unique shape to indicate to the user where to push the print cartridge down to eject the cartridge from the carriage of a printer. Such downward motion releases the print cartridge from the latch spring on the carriage.

Referring to FIGS. 1 and 7, reference numeral 48 generally indicates an island located on the top surface of the lid 31 and displaced away from the margin between the lid 31 and the front wall 24 of the print cartridge body 12. The island 48 includes a latch 50 for securing the print cartridge 11 within a printer carriage. Referring to FIGS. 1, 2, and 5, the latch 50 is located on the lid 31 and not on the front wall 24 so that the print cartridge can be manufactured with existing equipment and without requiring new tooling. As illustrated in FIGS. 1, 2, and 5, the latch has a triangular cross section formed by a latch ramp 51 and a latch wall 52. The latch ramp 51 has three functions: to gradually increase the installing or latching force that must be exerted by the user when installing the print cartridge 11 in a printer; to ease the opening of the latch spring during installation; and to continuously force the print cartridge 11 out of the printer until the print cartridge is precisely seated in the carriage. This latter feature prevents "false latching" of the print cartridge. The latch wall 52 is located perpendicular to the outside surface of the lid 31 and is the surface engaged by the latch spring when the print cartridge is precisely seated in the carriage of the printer.

The island 48, FIG. 7, further includes a latch well 54 located behind the latch wall 52. The latch well is a relieved area in the lid 31 that permits the latch spring to travel below the outside surface of the lid as necessary to maintain a constant latching force during the life of the printer. The island 48 also has two sets of keys 56 located on either side of the latch 50 that identify the print cartridge 11 to the printer.

While the print cartridge described above contains three ink reservoirs and three vents 40, FIGS. 1 and 7, it is contemplated that one or more reservoirs with one or more vents can also be used. In the printer that is planned for this print cartridge, one print cartridge having one reservoir containing only black ink will be installed adjacent to a second print cartridge having three reservoirs containing the three primary hues.

Further, it is contemplated that a print cartridge can be used that does not require a lid 31 as described above. Such a cartridge would need only a top wall with the appropriate vent(s) that seals the one or more reservoirs.

Although specific embodiments of the invention have been described and illustrated, the invention is not to be limited to the specific forms or arrangement of parts so described and illustrated. The invention is limited only by the claims.

We claim:

1. An ink-jet print cartridge which is elongate in a horizontal direction, and which is loadable into a printer carriage by substantially only horizontal relative motion, said ink-jet print cartridge, comprising:

a) a rectangular prismatic print cartridge body;

b) said print cartridge body having a lower wall carrying a substantially planar print head with an array of vertically extending fine-dimension orifices from which issues droplets of ink substantially vertically downwardly during operation of said ink-jet cartridge, said ink-jet cartridge having a top wall opposite to and generally parallel with said lower wall and a generally vertical front wall intersecting with said top wall to define a margin for said top wall;

c) a latch securely affixed to said top wall of said print cartridge body along said margin; and said latch being located on said top wall and displaced away from the margin of the top wall.

2. The print cartridge of claim 1 wherein the top wall has a planar outside surface, and said latch further including a latch ramp leading to a latch wall located perpendicular to said outside surface of said top wall.

3. The print cartridge of claim 1 further including a pair of horizontally spaced apart and generally vertically extending side walls intersecting with said top wall to define respective side margins for said top wall, each of said pair of side walls defining one of a pair of oppositely outwardly extending supporting lips located along said side margins of said top wall.

4. A horizontally loadable ink-jet print cartridge, said print cartridge comprising:

a) a horizontally elongate generally rectangular print cartridge body having two horizontally elongate side walls having a length dimension which is a major dimension for said cartridge body, a front wall, and a back wall, said print cartridge body having a lower wall carrying a substantially planar print head with an array of vertically extending fine-dimension orifices from which issues droplets of ink substantially vertically downwardly during operation of said ink-jet cartridge;

b) a top wall having a planar outside surface, said top wall being affixed to said body; and c) a first elongate supporting lip located on a first side wall of said body, said lip being parallel to said planar outside surface of said top wall.

5. The ink-jet print cartridge of claim 4 further including a second elongate supporting lip located on a second side wall of said body, said second elongate supporting lip likewise being parallel to said planar outside surface of said top wall.

6. An ink-jet print cartridge especially configured for loading into a printer carriage by use of substantially only horizontal relative motion, said print cartridge comprising:

a) a horizontally elongate and generally rectangular print cartridge body having two side walls which are elongate in the horizontal direction and having a length dimension which is a major dimension for said print cartridge, a front wall, and a back wall;

b) a top wall affixed to said body along a margin;

c) a latch located on said top wall and displaced away from said front wall, and said margin of said top wall and said body; and d) a gripping surface on said print cartridge, said gripping surface being remotely located from said latch.

7. The ink-jet print cartridge of claim 6 wherein each of the two side walls has a common margin with the back wall and wherein the gripping surface is a rib located along one of the common margins.

8. An ink-jet print cartridge, comprising:

a) a generally rectangular print cartridge body having two side walls, a front wall, and a back wall;

b) a top wall affixed to said bodv along a margin;

c) a latch located on said top wall and displaced away from said margin of said top wall and said body; and d) a gripping surface on said print cartridge, said gripping surface being remotely located from said latch;

wherein said gripping surface includes a plurality of groves located along said margin between said top wall and said body.

9. The ink-jet print cartridge of claim 8 wherein said top wall has a planar outside surface and said gripping surface includes a plurality of grooves located on said planar outside surface of said top wall.

* * * * *